US012054318B2

(12) United States Patent
Graux

(10) Patent No.: US 12,054,318 B2
(45) Date of Patent: Aug. 6, 2024

(54) STOPPER HAVING A TAMPER-EVIDENT BAND

(71) Applicant: NOVEMBAL USA INC., Edison, NJ (US)

(72) Inventor: Stéphane Graux, Liergues (FR)

(73) Assignee: NOVEMBAL USA INC.

( * ) Notice: Subject to any disclaimer, the term of this patent is extended or adjusted under 35 U.S.C. 154(b) by 0 days.

(21) Appl. No.: 17/776,757

(22) PCT Filed: Nov. 12, 2020

(86) PCT No.: PCT/IB2020/060642

§ 371 (c)(1),
(2) Date: May 13, 2022

(87) PCT Pub. No.: WO2021/094963

PCT Pub. Date: May 20, 2021

(65) Prior Publication Data

US 2022/0396399 A1 Dec. 15, 2022

(51) Int. Cl.
*B65D 41/34* (2006.01)
*B65D 41/48* (2006.01)

(52) U.S. Cl.
CPC ..... *B65D 41/3428* (2013.01); *B65D 41/48* (2013.01)

(58) Field of Classification Search
CPC ..... B65D 41/3428; B65D 41/3423; B65D 41/34; B65D 41/48; B65D 41/365; B65D 41/36; B65D 41/3409; B65D 41/0421; B65D 51/1661; B65D 51/1633; B65D 51/16; B65D 2401/20
USPC ..... 215/250, 252–254, 256, 258, 341, 215/343–344, 329; 220/303–304, 293, 220/288, 265–266, 203.09, 203.01, 220/801–804, 806, 796; 222/541.6, 222/541.1, 563
See application file for complete search history.

(56) References Cited

U.S. PATENT DOCUMENTS 4,470,513 A * 9/1984 Ostrowsky ..... B65D 41/3428 215/253
4,511,053 A * 4/1985 Brandes ..... B65D 41/3438 215/252
4,572,388 A * 2/1986 Luker ..... B65D 41/3428 215/252
4,657,153 A * 4/1987 Hayes ..... B65D 41/3428 215/252
4,807,771 A * 2/1989 Roy ..... B65D 41/3433 215/252

(Continued)

OTHER PUBLICATIONS

International search report dated May 3, 2021.

*Primary Examiner* — Chun Hoi Cheung
*Assistant Examiner* — Brijesh V. Patel

(57) ABSTRACT

The invention includes a plastic stopper comprising a closure shell and a tamper band. The tamper band is separably connected to the closure shell through at least a weakness line and includes a hoop positioned at a bottom edge of the tamper band. The hoop is configured to invert into and secured under a ring of the bottle neck, and the hoop comprising a least one protrusion. The hoop is configured to inverted into the stopper and extend in front of an inner wall of the tamper band. The inner wall comprises a recess extending into a thickness of the inner wall, and the is recess configured to receive the at least one protrusion of the hoop.

12 Claims, 6 Drawing Sheets

(56) References Cited

U.S. PATENT DOCUMENTS 4,978,016 A 12/1990 Hayes
5,090,788 A 2/1992 Ingram et al.
5,129,530 A * 7/1992 Fuchs ..... B65D 41/3428 215/252
5,400,913 A * 3/1995 Kelly ..... B65D 41/3428 215/252
5,450,973 A 9/1995 Ellis et al.
5,462,184 A * 10/1995 Ingram ..... B65D 41/3428 215/252
5,540,344 A * 7/1996 Rosenthal ..... B65D 55/0827 215/901
5,570,798 A * 11/1996 Hayashida ..... B65D 41/3428 215/252
5,660,289 A * 8/1997 Spatz ..... B26D 7/01 215/252
5,678,714 A * 10/1997 Guglielmini ..... B65D 41/3428 215/258
5,755,347 A * 5/1998 Ingram ..... B29C 57/00 215/252
5,813,553 A 9/1998 Herr et al.
6,085,921 A 7/2000 Brown
6,119,883 A * 9/2000 Hock ..... B65D 41/3428 53/485
6,253,939 B1 * 7/2001 Wan ..... B65D 41/3428 215/901
6,736,280 B1 * 5/2004 Zapata ..... B65D 41/3428 215/256
7,344,039 B2 * 3/2008 Bixler ..... B65D 41/3428 215/258
7,445,130 B2 * 11/2008 Bosl ..... B65D 41/3428 215/258
8,123,056 B2 * 2/2012 Falzoni ..... B65D 41/3409 215/44
2001/0002661 A1 * 6/2001 Reidenbach ..... B65D 41/3428 215/252
2020/0223597 A1 * 7/2020 Neputy ..... B65D 41/3423

* cited by examiner

STOPPER HAVING A TAMPER-EVIDENT BAND

FIELD OF INVENTION

The invention relates to a plastic stopper of any of the screw or snap types.

TECHNICAL FIELD

The present invention relates to the field of packaging, wherein it is very common to seal the aperture of a container with a stopper such as a closure or cap.

Such container is an individual object. The container is usually made of plastic, glass or metal material. The container can be a bottle filled with a fluid or a liquid, especially of a food or a cosmetic product.

The stopper can be made of metal or plastic material. A plastic stopper is mainly obtained through a molding process.

Such stoppers generally have a tubular or cylindrical shaped body closed at its top edge by a roof wall. The stopper body includes a closure shell attached at a bottom edge to a tamper band (so called "tamper evident ring") through a weakness line. Such weakness line is made of bridges, distributed around the closure shell and the tamper band. So the bridges link the closure shell and the tamper band together. Moreover the bridges are made when molding the stopper or after molding through a cutting step.

In order to engage the stopper to seal the container, the stopper neck includes one or more outer fixation features, such as thread(s) for screw type stopper or annular fixation rings for snap type stopper.

In conventional screw-type stoppers, the closure shell comprises inner thread(s) arranged inside side walls. The container neck fixation feature comprises outer thread(s). Such combination of outer and inner thread(s) allows the stopper to be screwed on the container neck to seal said container and unscrewed for container entirely opening.

In conventional snap-type stoppers include an inner annular area and the container neck fixation feature comprises outer fixation ring, in order to slot in force the stopper on the container neck. Moreover a snap-type stopper comprises a closure shell with a sealing roof movable from a closure position to a part opening, and reversely. The roof may be separated upon opening or may be connected with the closure shell through a hinge.

Usually, the closure shell is removable. During container or bottle opening, the bridges of the weakness line are torn apart from the closure shell, so it is separated from the bottle. After opening, the closure shell can stay attached to the tamper band secured on the container neck through a link: such stopper is so called a "tethered stopper". The weakness line is torn when user unscrews the closure shell of the stopper or when user lifts the roof wall by tilting.

Moreover, in a container sealing position of the stopper, the tamper band is secured around said container neck through a hoop. Such hoop is attached at the bottom of the tamper band. The hoop inwardly extends relating to the inner wall of the tamper band. In a stopper sealing position, the hoop cooperates under a ring outwardly extending from the outer wall of the neck. So the hoop of the tamper band comes in support from bottom to top against the ring of the container neck. Such hoop is also called "folded band".

Known stoppers have tamper band with a plane inner wall. Such inner wall extends almost vertically. So, when inserting the stopper on the bottle neck, the hoop outwardly pushes against the inner wall and the tamper band is deformed.

Such deformation of the tamper band comes to pull on the bridges of the weakness line and occurs some bridges to break. Indeed, the bridges is the thickest part of the stopper at the closest where the outward radial forces apply.

The closure shell is no longer totally attached to the tamper band, which is not desired because linking of the closure with the tamper band has a role of evidence for consumer that the container was not previously opened.

SUMMARY OF INVENTION

An object of the present invention is to improve a stopper shaped so that when sealing the stopper is positioned on a container neck, the passage of the ring of the bottle neck by the hoop of the tamper band does not break the bridges of the weakness line between the tamper band and the closure shell.

According to the invention, the tamper band has an inner wall comprising a recess, in order to receive a part of the hoop when it is folded. So a part of the hoop, especially situated at a top part of the hoop, enters at least partially into the recess, decreasing the outward radial forces of the tamper band.

Moreover the recess causes the tamper band to be thinner than usual, so that a part of the outward radial forces are dispatched at the top beginning of the recess and the closest bridges, so said bridges does not break anymore.

Due to the stopper fabrication process by molding, the stopper is released from a central core of a mold and the hoop extends downward relating to the tamper band. Then, the hoop must be inverted inside the stopper, from bottom to top, to get into an inward position relating to the tamper band where the hoop will cooperate with the neck ring when the stopper is engaged to seal the container.

When the hoop is in the inward position, the stopper is placed on the container neck in order to seal it. Such sealing operation includes a step when the tamper band and the hoop must go from top to bottom through the ring of the neck. During the passage of the ring, the hoop is pushed outwardly until it is blocked against the inner wall of the tamper band, the hoop being folded around the bottom junction with the tamper band. Then, when going under the ring, the hoop elastically comes back and secures the stopper on the bottle neck.

BRIEF DESCRIPTION OF THE DRAWINGS

The invention can be better understood on reading the following description given merely by way of example and with reference to the accompanying drawings, in which.

DESCRIPTION OF EMBODIMENTS

A stopper 1 according to the invention has a global tubular or cylindrical shaped body. The stopper 1 is closed at a top end and opened at a bottom end. So the stopper 1 can be inserted, from top to bottom, on an opening of a container neck 2 in order to seal said container.

Such container is an individual object. The container is usually made of plastic, glass or metal material. The container can be a bottle filled with a fluid or a liquid, especially a fluid or a liquid of a food or a cosmetic product. According to the invention, the stopper 1 can be a screw type or a snap type.

In order to engage the stopper 1 to seal the container, the neck 2 comprises outer fixation feature 20, such as thread(s) for screw type stopper 1 or annular fixation ring(s) for snap type stopper 1.

In order to cooperate with the fixation feature 20 of the neck 2, the stopper 1 comprises corresponding inner features 4. Such inner features 4 depends on the type of the stopper 1.

According to a screw type stopper 1, the inner features 4 are inner thread(s) arranged inside side walls. The thread(s) are dimensioned relating to the inner thread(s), so that the stopper 1 can be screwed on the neck 2 to seal the container, and unscrewed for entirely opening said container.

In order to easily unscrew of the stopper 1, the body can comprise outward stripes. Such stripes almost extend vertically. The stripes are also used to engage the stopper 1 on the neck 2 when sealing the container.

Figure 5:
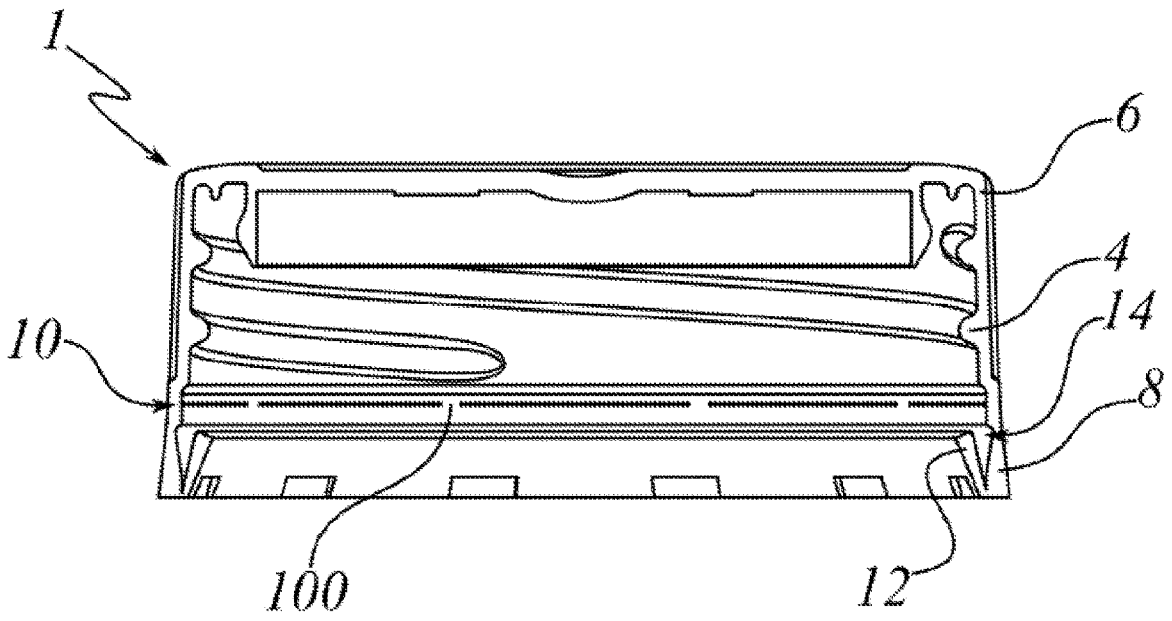
FIG. 5 is a cross section view of the stopper of FIG. 1, wherein the hoop is reverted.
Figure 6:
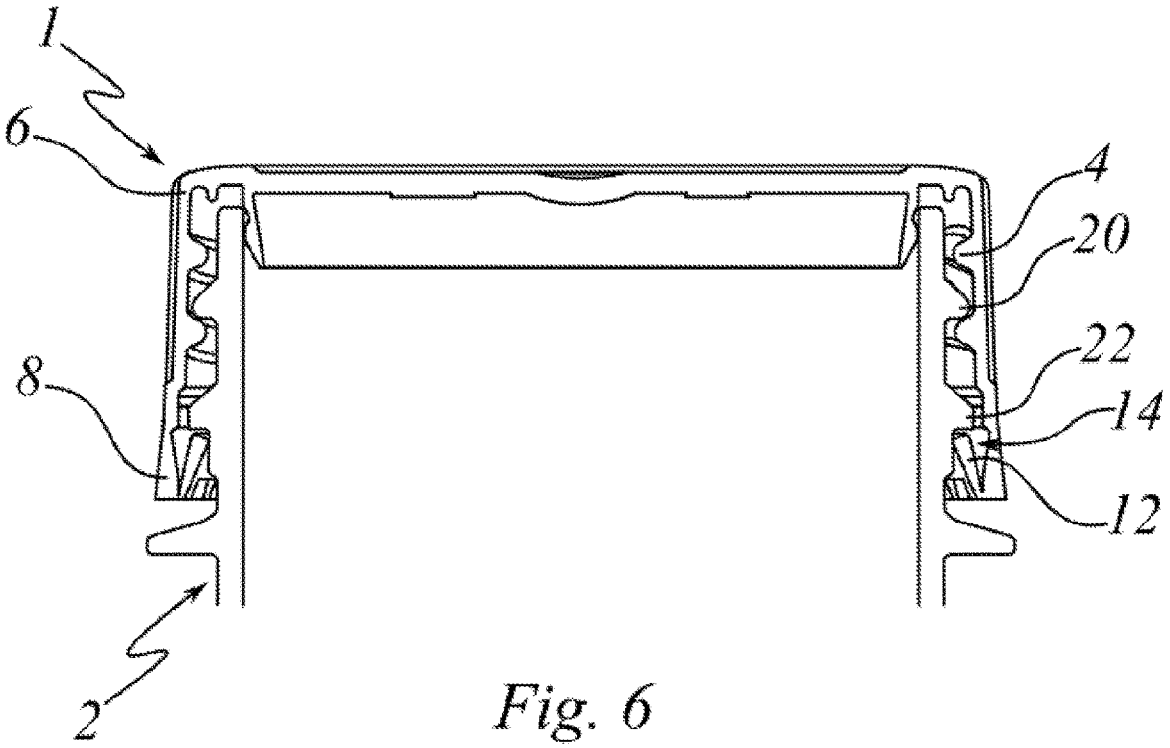
FIG. 6 is a section view of the stopper of FIG. 5, wherein the stopper is secured on a bottle neck.

An example of a screw type stopper 1 is especially shown in FIGS. 5 and 6. According to a snap type stopper 1, the inner features 4 comprises inner annular area arranged inside side walls, in order to slot in force the stopper 1 on the container neck 2. So in a sealing position, an snap type stopper 1 can hardly be removed from the neck 2.

Moreover, a snap type stopper 1 comprises a top end with a roof wall movable from a closure position to a part opening, and reversely. The roof may be separated upon opening or may be connected with the closure shell through a hinge.

The neck 2 comprises a ring 22. Such ring 22 outwardly extends around the neck 2, under the fixation feature 20. The ring 22 cooperates with feature inwardly managed at the bottom of the stopper 1, in order to secure the stopper 1 on the neck 2.

The stopper 1 comprises a closure shell 6 and a tamper band 8.

The closure shell 6 is attached at a bottom edge to the tamper band 8 (also called "tamper evident ring") through at least a weakness line 10.

A weakness line 10 is made of bridges 100, distributed around the closure shell 6 and the tamper band 8. So the bridges 100 link the closure shell 6 and the tamper band 8 together. Moreover the bridges 100 are made when molding the stopper 1 or after molding through a cutting step.

As such, according to the invention, the stopper 1 can be made from plastic material. A plastic stopper 1 is mainly obtained through a molding process, eventually followed by a cutting step of at least one weakness line 10.

When container first opening, the bridges 100 of the at least one weakness line 10 are torn apart from the closure shell 6, so it is separated from the container neck 2.

After opening, the closure shell 6 can stay attached to the tamper band secured on the container neck 2 through a link. Such a stopper 1 is known as a tethered stopper.

The weakness line 10 is torn when user unscrews the closure shell 6 or when user lifts a roof wall by tilting. So the user opens the bottle by moving away a movable part of its body (i.e. the closure shell 6 or the roof wall).

So, to secure the unmovable part of the stopper 1 on the neck 2 when sealing but also when opening, the tamper band 8 comprising at its bottom edge a hoop 12 to be secured under the ring 22 of the neck 2. When the tamper band 8 is secured through the cooperation of the hoop 12 with the ring 22, only the movable part of the body of the stopper 1 can be moved upwardly.

Such hoop 12 can have any shape section. Especially the hoop 12 globally has a triangular shape section. The hoop 12 is linked at a bottom thinner end 120 to the tamper band 8.

Due to the molding fabrication, such hoop 12 extends downward from the bottom of the tamper band 8 when the stopper 1 is ejected from mold. Then, during a specific step, the hoop 12 is inverted inside of the stopper 1. So the inverted hoop 12 extends in front of an inner wall 80 of the tamper band 8. When inverting the hoop 12, the thinner end 120 is folded, acting as a hinge. Once inverted the hoop 12 can hardly come back to its original state (i.e., prior to inversion), due to a flexible blocking exerted at a flexible line along the thinner end 120.

Thenceforth the hoop 12 is inverted inside the stopper 1, when sealing the neck 2, the hoop 12 must pass downward through the ring 22, from top to bottom. So when passing through the ring 22, the hoop 12 is moved around the bottom thinner end 120 against the inner wall 80 of the tamper band 8, causing radial outer forces exerted on the tamper band 8. Such forces could break the bridges 100 of the weakness line 10, which is not desirable, as the physical integrity of the bridges 100 is a proof for the consumer that the stopper 1 was not previously opened.

According to the invention, in order to minimize or avoid the breaking of any bridge 100, the inner wall 80 comprises a recess 14 extending into a thickness of the inner wall 80. So the recess 14 is managed from inside into the thickness of the tamper band 8, along the inner wall 80 of the tamper band 8. So the thickness of the tamper band 8 in the area of the weakness line 10 is greater than the thickness. Especially, the thickness of the tamper band 8 in the area of the recess 14 is at least less than 0.05 millimeter than thickness of the tamper band 8 in the area of the weakness line 10. The recess 14 can have a depth of approximately at least 5% relative to the thickness of the tamper band 8 in the area of the weakness line 10.

Thenceforth a part of the hoop 12 can enter into the recess 14 when passing through the ring 22 and the outer radial forces are decreased, so the bridges 100 have less chance to break during the sealing of the stopper 1 on the neck 2. Also, the recess 14 causes the tamper band 8 to be thinner than usual in this area, thus a part of the outward radial forces are dispatched at the top beginning of the recess 8 where the tamper band 8 is thinner than the recess 14. Therefore, the closest bridges 10 does not break anymore.

Figure 13:
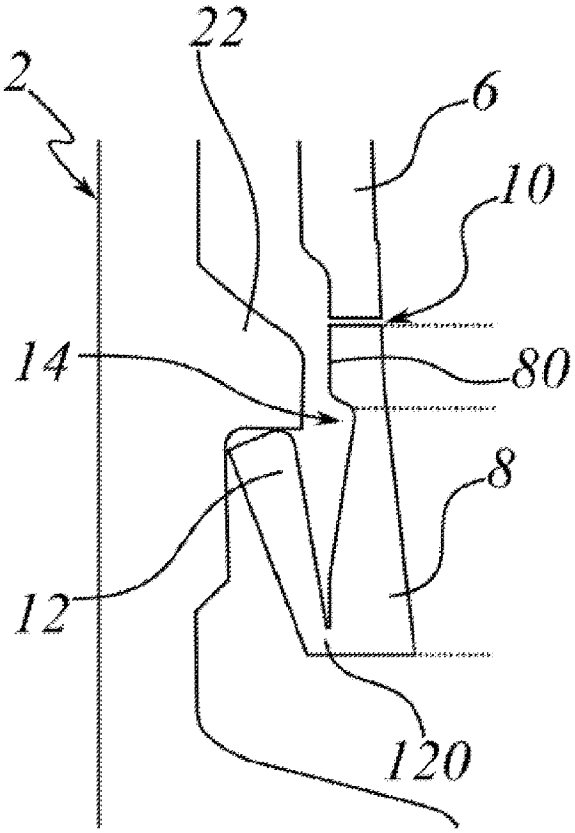
FIG. 13 is a similar view of FIG. 11, during a third step, wherein the hoop stretches back below the ring in a secure position of the stopper on the bottle neck.
Figure 12:
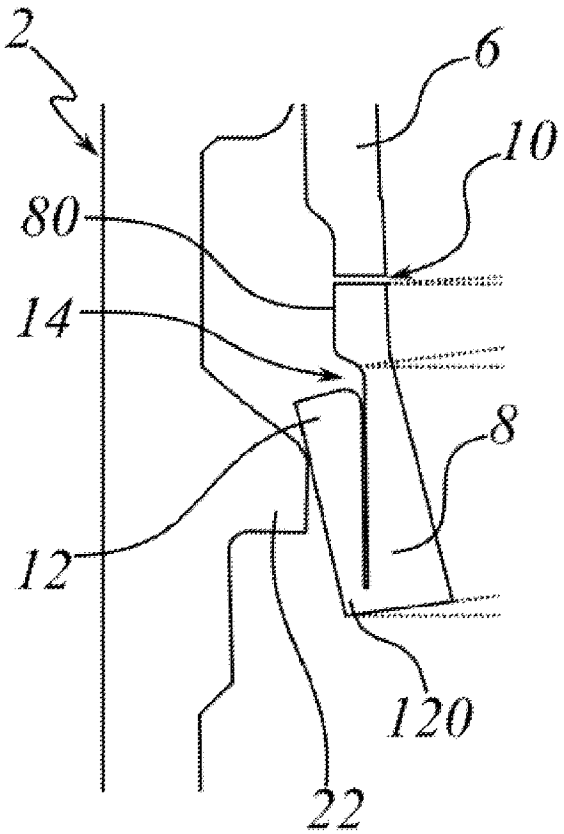
FIG. 12 is a similar view of FIG. 9, during a second step, wherein the hoop bends into the recess when crossing the ring of the bottle neck.
Figure 11:
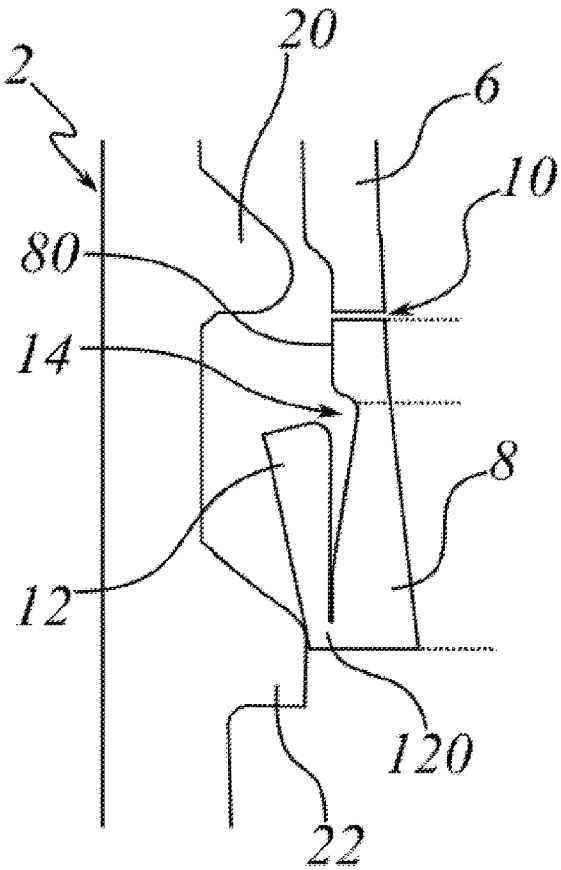
FIG. 11 is a detailed section view of the second embodiment, during a first step when inserting the stopper on the bottle neck.

As visible on the FIGS. 11 to 13, partially showing a second preferred embodiment of the stopper 1 during three steps when inserting the stopper 1 on a neck 2, the hoop 12 at least partially enters the recess 14, causing a pivot line at the top thinner area of the tamper band 8 and decreasing a less rotation on the weakness line 10 which is situated above the pivot line.

Especially visible on FIG. 13, after the hoop 12 passed the ring 22, the hoop 12 comes back due to the elasticity of the plastic material, in particular at the thinner end 120, acting like a resilient hinge to push back the hoop 12 into the secure position under the ring 22. Thus, the stopper 1 can no more be removed from the neck 2 except by breaking the weakness line 10. Therefore, the hoop 12 retains the tamper band 8 against the ring 22 so that the closure shell 6 or the roof wall can only upwardly move when user acts on it.

Figure 1:
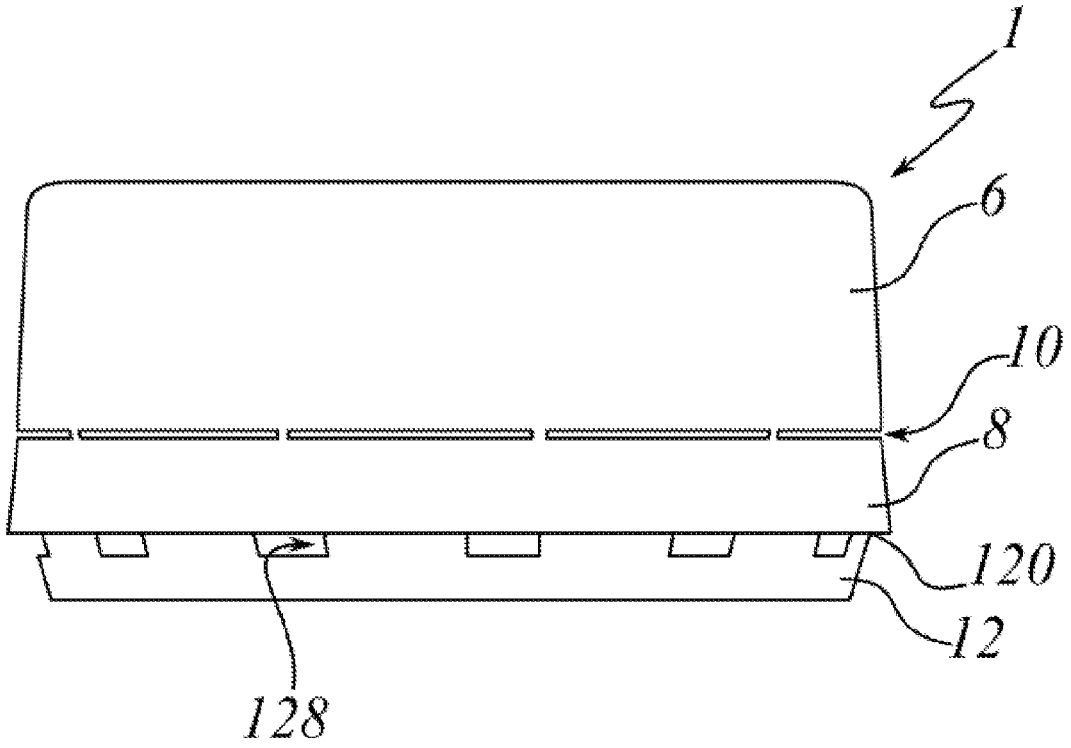
FIG. 1 is a front view of a stopper according to the invention, wherein the hoop downwardly extends from the tamper band.
Figure 2:
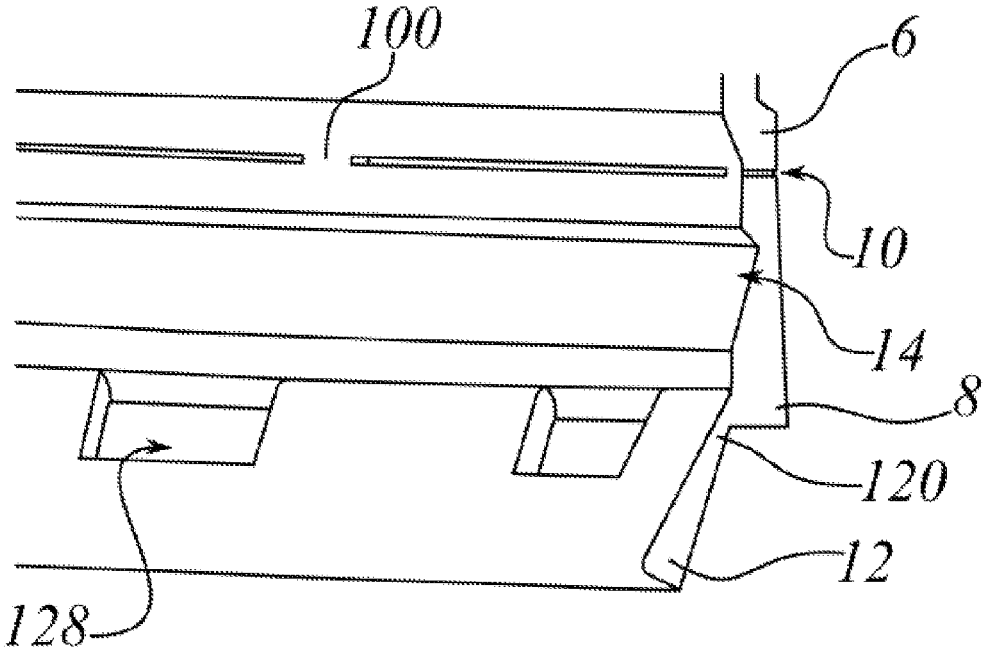
FIG. 2 is a detailed perspective view of an embodiment of the stopper, wherein the hoop downwardly extends relative to the tamper band.

According to an embodiment of the stopper 1, the recess 14 continuously extends around the inner wall 80. So the recess 14 is a unique groove inwardly surrounding the tamper band 8 along the inner wall 80. An embodiment of a continuous recess 14 is partially shown in FIG. 2.

According to another embodiment of the stopper 1, the recess 14 intermittently extends around the inner wall 80. So the recess 14 comprises hollows 140. So the hollows 140 are cavities where the hoop 12 partially enters when the stopper 1 passes through the ring 22.

Moreover, especially, the hoop 12 comprises tongues 122 linked together by a thinner part 124 of the hoop 12. So two adjacent tongues 122 are separated by the thinner part 124. In some embodiments, the tongues 122 are paddle-shaped. Furthermore, the hollows 140, the tongues 122 and the thinner part 124 are shaped with complementary dimensions, in order to allow cooperation by partially insertion of the tongues 122 of the hoop 12 into the hollows 140 of the recess 14. Especially, each tongue 122 faces one of the hollows 140 of the recess 14. So the tongues 122 partially enters into the hollows 140 in order to decrease the forces applied to the tamper band 8 when passing through the ring 22.

Figure 3:
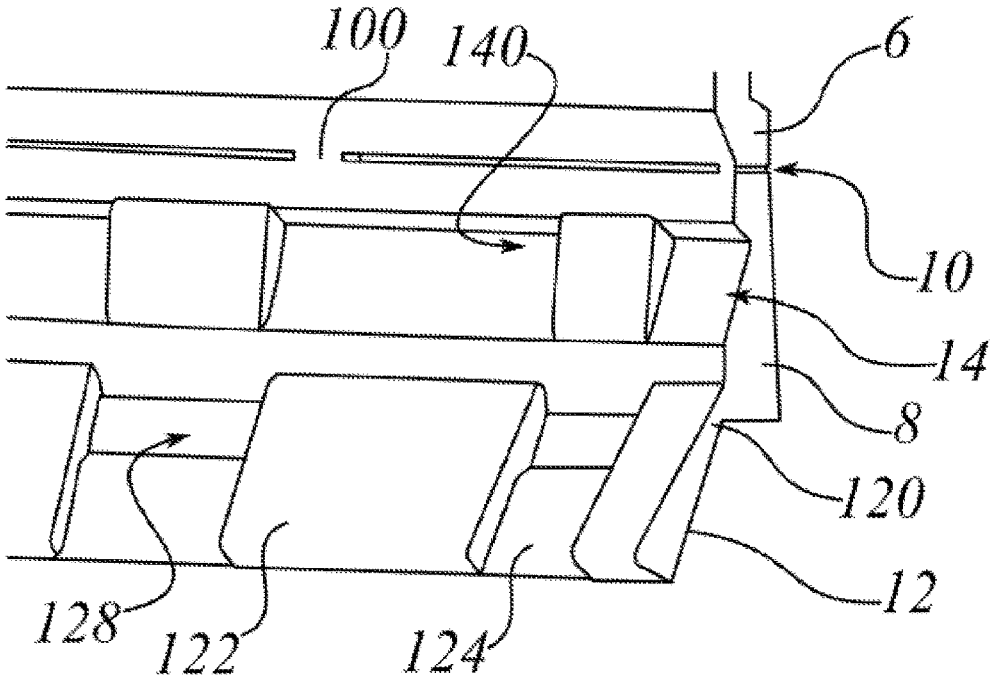
FIG. 3 is a detailed perspective view similar to FIG. 2 of another embodiment of the stopper, wherein the recess comprises hollows and the hoop comprises corresponding tongues linked through thinner parts.
Figure 4:
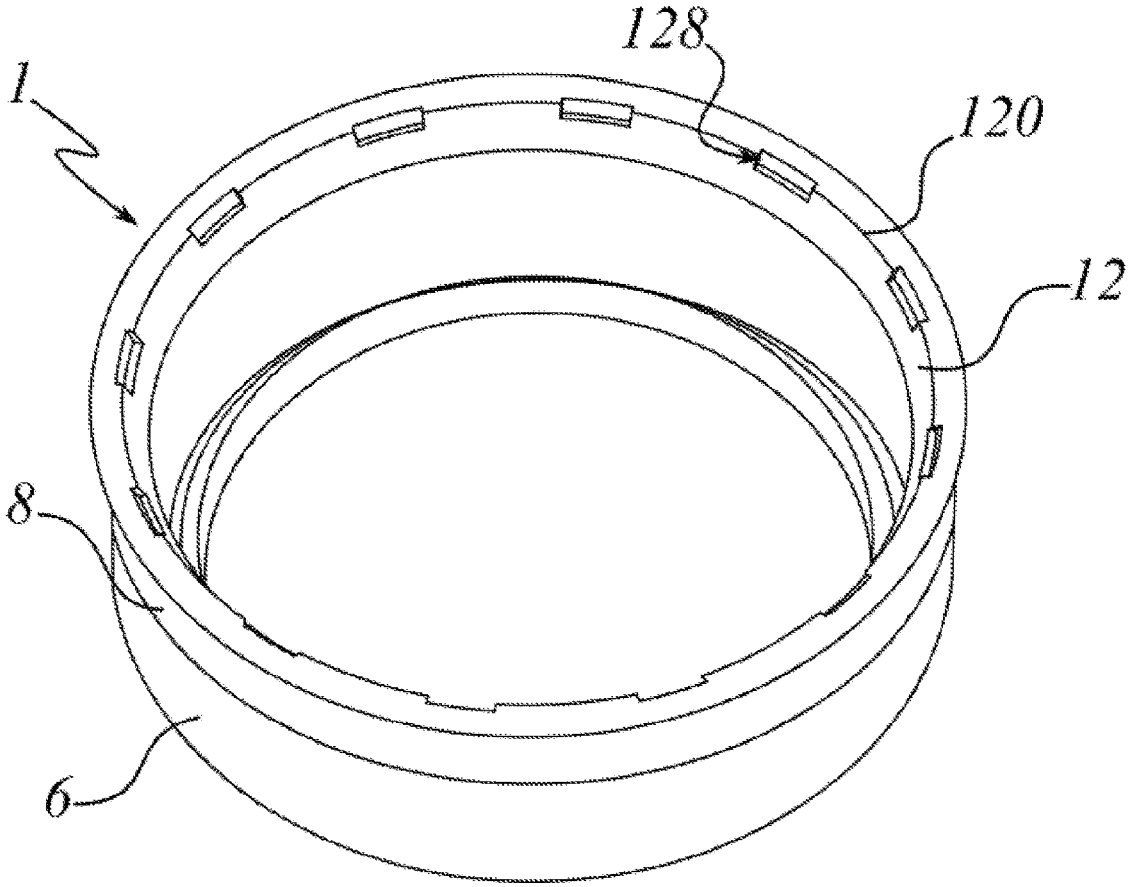
FIG. 4 is a perspective bottom view of the stopper of FIG. 1, wherein the hoop is reverted into the stopper.

An embodiment of a discontinuous or intermittent recess 14 with hollows 140 and a hoop 12 prior to inversion with tongues 122 is partially shown in FIG. 3.

Figure 7:
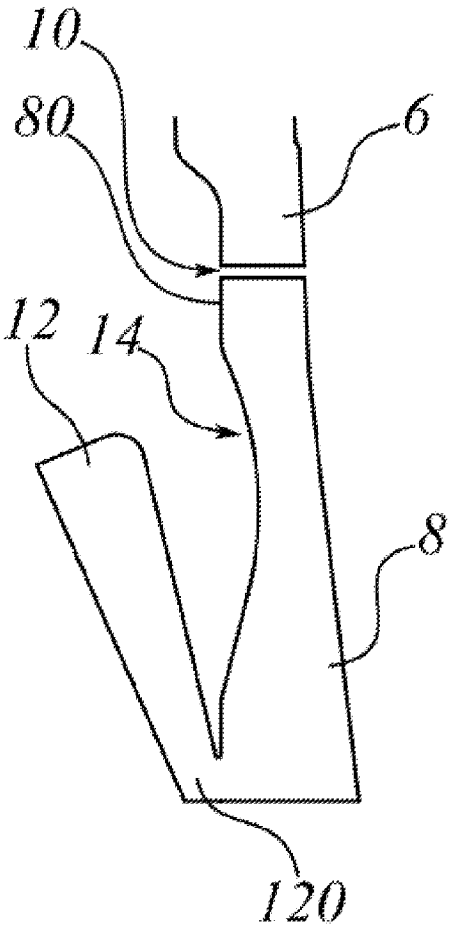
FIG. 7 is a detailed section view of a first embodiment of the stopper; wherein the recess of the tamper band is round.

According to a first embodiment, as shown in FIG. 7, the recess 14 is round shaped. So the recess 14 has a concave curved section. This round shape limits the risk of tear when the hoop 12 enters partially into the recess 14. Especially the recess round shape avoids tear at the top end of the recess 14.

Figure 8:
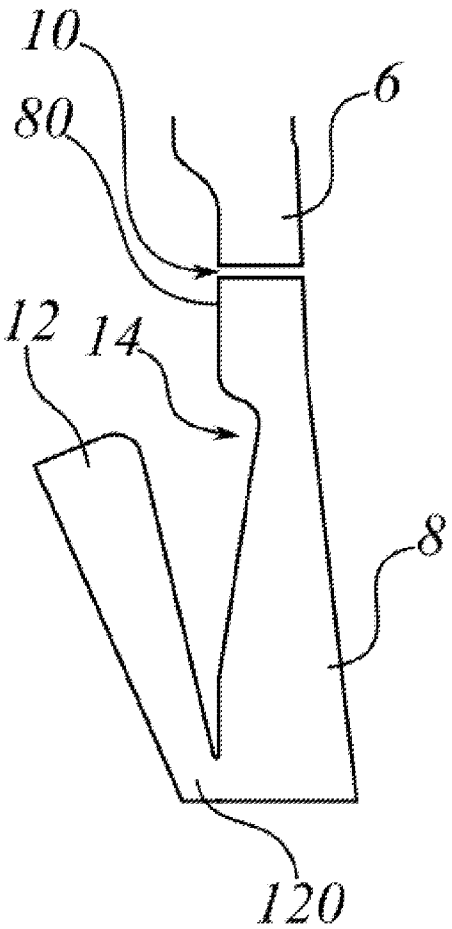
FIG. 8 is a detailed section view of a second embodiment of the stopper; wherein the recess is beveled.

According to a second and embodiment, as shown in FIG. 8, the recess 14 is beveled at a top extremity. So the recess 14 has a section which is globally triangular shaped. Such recess beveled shaped improves the introduction of the part of the hoop 12 into the recess 14.

Figure 10:
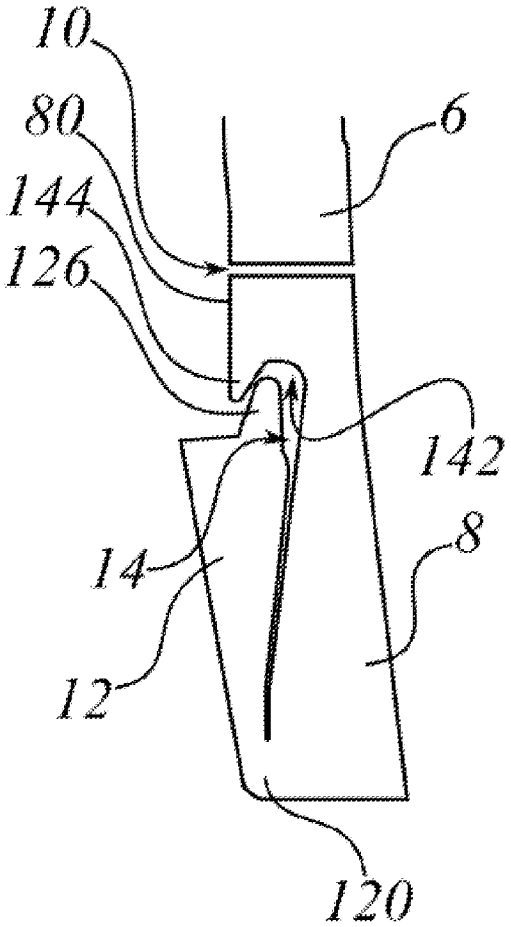
FIG. 10 is a similar view of FIG. 9, wherein the hoop is hooked into the recess.
Figure 9:
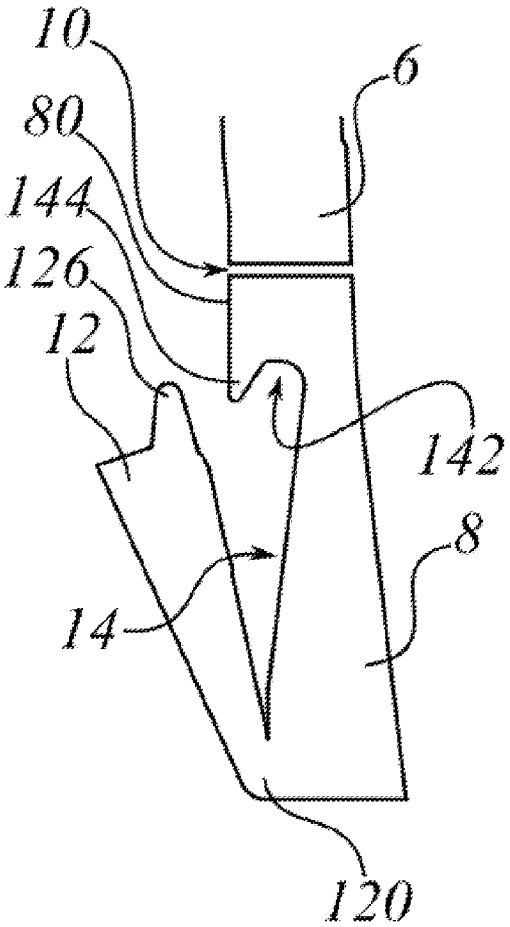
FIG. 9 is a detailed section view of a third embodiment of the stopper; wherein the hoop has a hook.

According to a third embodiment, as shown in FIGS. 9 and 10, the hoop 12 comprises at a distal periphery a hook 126. So the hook 126 is situated at the opposite of the thinner end 120. Such hook 126 cooperates to block the hoop 12 into the recess 14 when passing through the ring 22 and after. So the recess 14 comprises an upper housing 142 shaped to receive the hook 126. Such housing 142 is managed upwardly into the thickness of the tamper band 8, with a part of the inner wall 80 extending downward, like an almost vertical lip 144. Due to its low thickness and the elastic plastic material, such lip 144 does not break and allows the hook 126 to enter the housing 142 and to be blocked therein, even under the elastic resilience of the folded thinner end 120. When the hook 126 blocked into the housing 142, the opposite wall of the hoop 12 essentially extends vertically or is more vertical than in other embodiments, so that the secure position of the hoop 12 under the ring 22 is improved due to the verticality of the hoop 12.

According to some embodiments, the edges of the recess 14 are unsharp or roundly shaped, in order to avoid any weakness tear areas likely to create breaking into the plastic material of the tamper band 8.

The stopper 1 according to the invention, with a recess 14 made into the inner wall 80 of the tamper band 8, facing the reverted hoop 12, to receive of part of said hoop 12, decreases the risk of breaking of the bridges 100 of the weakness line 10, when passing through the ring 22 of the neck 2 to engage and seal the container. Moreover, such configuration of the stopper 1 makes easier the sealing on the neck 2, decreasing the frictions between the stopper 1 and the neck 2 and the risk of plastic deformations. So the stopper 1 offers a better laying on the neck 2, even if the stopper 1 is not initially straight engages on the neck 2.

Moreover, the recess 14 confers more elasticity to the tamper band 8, so the dimensions of the at least one weakness line 10 can be increased, with thicker bridges 100. Thus when the stopper 1 is engaged, such bigger bridges 100 have less chance to break.

Especially the recess 14 creates a bigger space between the hoop 12 and the inner wall 80 of the tamper band 6, and also the outer wall of the neck 2, so that more liquid can enter into the stopper 1 after engaged on the neck 2 when washing the sealed container. The washing liquid is injected through holes 128 managed into the bottom of the reverted hoop 12.

The invention claimed is:

1. A plastic stopper, comprising:

a closure shell and a tamper band, the tamper band being separably connected to the closure shell through at least a weakness line, the tamper band comprising a hoop having a proximal end connected at a bottom edge of the tamper band, the hoop configured to be to inverted into and secured under a ring of the bottle neck, the hoop comprising at least two protrusions and a connecting web defined therebetween such that a distal end of the hoop is continuous, the hoop being inverted into the stopper and extending in front of an inner wall of the tamper band, wherein the inner wall comprises a recess extending into a thickness of the inner wall, the recess configured to receive the at least two protrusions of the hoop.

2. The plastic stopper according to claim 1, wherein the recess continuously extends around the inner wall.

3. The plastic stopper according to claim 1, wherein the recess intermittently extends around the inner wall, the recess comprising a plurality of hollows.

4. The plastic stopper according to claim 3, wherein the at least two protrusions of the hoop comprise a plurality of tongues linked together by connecting webs, wherein each of the plurality of tongues face one of the plurality of hollows of the recess.

5. The plastic stopper according to claim 1, wherein the recess is round shaped.

6. The plastic stopper according to claim 1, wherein the recess is beveled at a top extremity.

7. The plastic stopper according to claim 1, wherein the hoop comprises a hook at a distal periphery, and the recess comprises an upper housing shaped to receive the hook.

8. A plastic stopper, comprising:

a closure shell and a tamper band, the tamper band being separably connected to the closure shell through at least a weakness line, the tamper band comprising a hoop positioned at a bottom edge of the tamper band, the hoop comprising a proximal end and a distal end with the proximal end connected to the bottom edge of the tamper band, the hoop configured to be to inverted into and secured under a ring of the bottle neck, the hoop comprising at least two protrusions and a thinner part defined therebetween such that the distal end of the hoop is continuous, the hoop being inverted into the stopper and extending in front of an inner wall of the tamper band, wherein the inner wall comprises a recess extending into a thickness of the inner wall, the recess configured to receive the at least two protrusions of the hoop.

9. The plastic stopper according to claim 8, wherein the recess intermittently extends around the inner wall, the recess comprising a plurality of hollows.

10. The plastic stopper according to claim 9, wherein the at least two protrusions of the hoop comprise a plurality of tongues linked together by connecting webs, wherein each of the plurality of tongues face one of the plurality of hollows of the recess.

11. A plastic stopper for sealing a container, the container comprising a neck having a fixation feature and a ring positioned below the fixation feature, the plastic stopper comprising:

a closure shell and a tamper band;

the tamper band being separably connected to the closure shell through at least a weakness line, the tamper band comprising a hoop positioned at a bottom edge of the tamper band, the hoop comprising a proximal end and a distal end with the proximal end hingedly connected to the bottom edge of the tamper band, the hoop configured to be to inverted into and secured under the ring of the container neck, the hoop comprising a plurality of spaced-apart protrusions and a thinner connecting web defined between each of the plurality of spaced-apart protrusions such that the distal end of the hoop is continuous, the hoop being inverted into the stopper and displaced in front of an inner wall of the tamper band, wherein the inner wall comprises a plurality of spaced-apart recesses formed within a thickness of the inner wall, the plurality of spaced-apart recesses configured to receive the plurality of spaced-apart protrusions.

12. The plastic stopper of claim 11, wherein each of the plurality of spaced-apart protrusions is configured to align with a respective recess of the plurality of spaced-apart recesses.

* * * * *